United States Patent [19]

Thorogood et al.

[11] Patent Number: 4,848,996

[45] Date of Patent: Jul. 18, 1989

[54] NITROGEN GENERATOR WITH WASTE DISTILLATION AND RECYCLE OF WASTE DISTILLATION OVERHEAD

[75] Inventors: Robert M. Thorogood; Thomas M. Roden, both of Macungie, Pa.

[73] Assignee: Air Products and Chemicals, Inc., Allentown, Pa.

[21] Appl. No.: 254,510

[22] Filed: Oct. 6, 1988

[51] Int. Cl.[4] ..... F25J 3/00

[52] U.S. Cl. ..... 62/39; 62/44

[58] Field of Search ..... 62/11, 36, 38, 39, 44

[56] References Cited

U.S. PATENT DOCUMENTS

| | | | |
|---|---|---|---|
| 3,210,951 | 10/1965 | Gaumer | 62/29 |
| 3,277,655 | 10/1966 | Geist et al. | 62/29 |
| 3,327,489 | 6/1967 | Gaumer | 62/29 |
| 3,754,406 | 8/1973 | Allam | 62/41 |
| 4,222,756 | 9/1980 | Thorogood | 62/13 |
| 4,453,957 | 6/1984 | Pahade et al. | 62/25 |
| 4,464,191 | 8/1984 | Erickson | 62/31 |
| 4,617,036 | 10/1986 | Suchdeo et al. | 62/11 |
| 4,702,757 | 10/1987 | Kleinberg | 62/24 |
| 4,704,147 | 11/1987 | Kleinberg | 62/24 |
| 4,704,148 | 11/1984 | Kleinberg | 62/24 |
| 4,705,548 | 11/1987 | Agrawal et al. | 62/38 |
| 4,707,994 | 11/1987 | Shenoy et al. | 62/38 |

*Primary Examiner*—Ronald C. Capossele

*Attorney, Agent, or Firm*—Willard Jones II; James C. Simmons; William F. Marsh

[57] ABSTRACT

The present invention is an improvement to a standard nitrogen generator. The improvement is two-fold; first, the addition of one or more distillation stages above the reboiler, which stages effectively transform the reboiler/condenser into a partial low pressure column and allow further separation (rectification) of the nitrogen generator bottoms liquid into two streams. Second, the recycle of the overhead stream (at a composition close to that of air) from the top of the low pressure column to the main air compressor. Additionally, at least a portion of the oxygen-enriched stream that exits the low pressure column below the bottom tray is expanded to provide refrigeration for the cycle.

3 Claims, 2 Drawing Sheets

NITROGEN GENERATOR WITH WASTE DISTILLATION AND RECYCLE OF WASTE DISTILLATION OVERHEAD

TECHNICAL FIELD

The present invention is related to a process for the cryogenic distillation of air or oxygen/nitrogen mixtures to produce a nitrogen product stream.

BACKGROUND OF THE INVENTION

Numerous processes are known in the art for the production of a nitrogen product stream by using cryogenic distillation. The conventional process for the production of pressurized nitrogen directly from a cryogenic separation zone uses a single pressure distillation column with the oxygen rich waste stream being used at least in part to provide the process refrigeration by work expansion.

SUMMARY OF THE INVENTION

The present invention is an improvement to a process for the separation of air or gas mixtures containing oxygen and nitrogen by cryogenic distillation. In the process, a feed gas (or air) stream is compressed by a multi-staged main compressor and subsequently cooled to near its dew point. The cooled feed gas (or air) stream is fed to a stripper and separated into a nitrogen overhead stream and an oxygen-enriched bottoms liquid. Also in the process, at least a portion of the nitrogen overhead is condensed in a reboiler/condenser against boiling oxygen-enriched bottoms liquid to provide reflux for the stripper and at least another portion of the nitrogen overhead is removed from the process as gaseous nitrogen product.

The improvement for producing gaseous nitrogen product in a more energy efficient manner is accomplished by rectifying the oxygen-enriched bottoms liquid in a distillation zone comprising one or more distillation stages into a synthetic feed gas (or air) recycle stream, which has a composition close to that of the feed stream, and an oxygen-enriched waste stream. The synthetic feed gas (or air) recycle stream is warmed to recover refrigeration and subsequently recycled to an intermediate stage of the multi-staged main compressor. At least a portion of the oxygen-enriched waste stream is reboiled in the reboiler/condenser thereby condensing at least a portion of the nitrogen overhead from the stripper and producing a gaseous oxygen-enriched stream. At least a portion of the gaseous oxygen-enriched stream is expanded and warmed to provide refrigeration for the process.

DETAILED DESCRIPTION OF THE INVENTION

The present invention is a modified standard plant cycle with one or more trays added above the reboiler that produces gaseous nitrogen (GAN) at high pressure with less compression power than a standard plant. The feed to the process, although typically being air, can be any gaseous mixture comprising oxygen and nitrogen.

Figure 1:
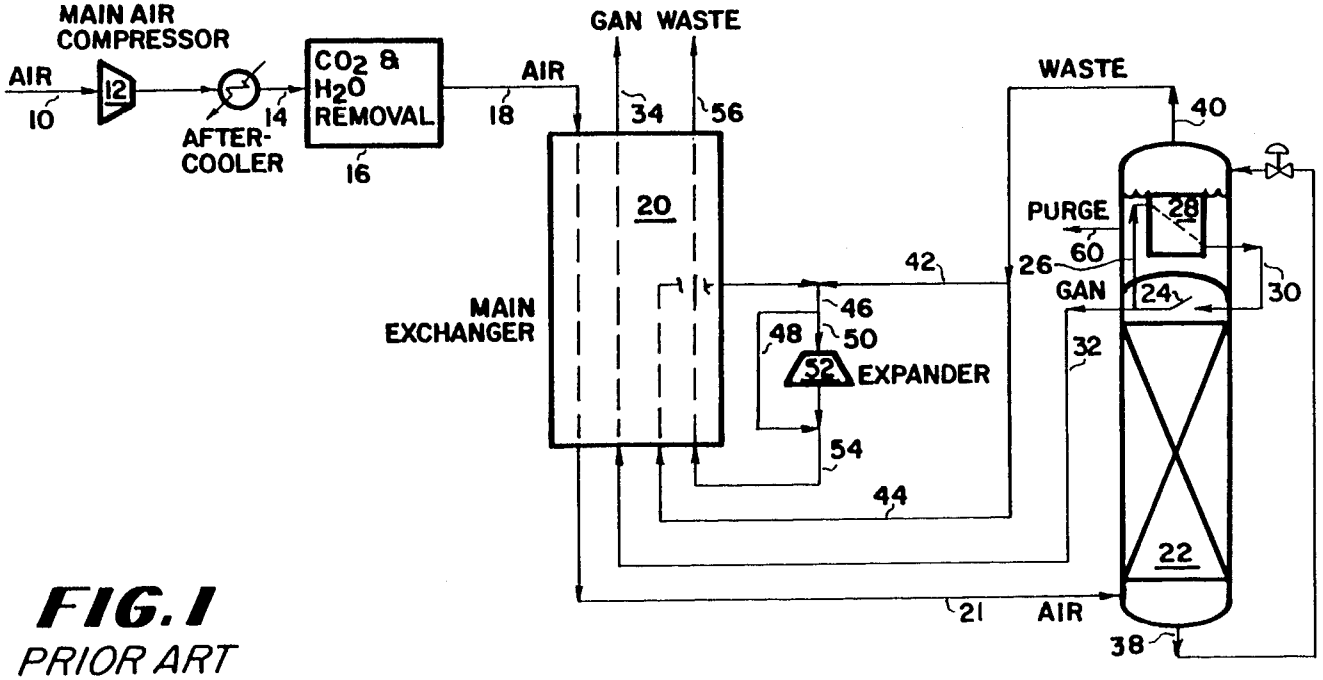
FIG. 1 PRIOR ART
FIG. 1 is a schematic diagram of a conventional nitrogen generator.

The process is best understood in relation to the prior art process, which is shown in FIG. 1.

With reference to FIG. 1, a feed air stream is fed to main air compressor (MAC) 12 via line 10. After compression the feed air stream is aftercooled usually with either an air cooler or a water cooler, and then processed in unit 16 to remove any contaminants which would freeze at cryogenic temperatures, i.e., water and carbon dioxide. The processing to remove the water and carbon dioxide can be any known process such as an adsorption mole sieve bed. This compressed, water and carbon dioxide free, air is then fed to main heat exchanger 20 via line 18, wherein it is cooled to near its dew point. The cooled feed air stream is then fed to the bottom of stripper 22 via line 21 for separation of the feed air into a nitrogen overhead stream and an oxygen-enriched bottoms liquid.

The nitrogen overhead is removed from the top of stripper 22 via line 24 and is then split into two substreams. The first substream is fed via line 26 to reboiler/condenser 28 wherein it is liquefied and then returned to the top of stripper 22 via line 30 to provide reflux for the stripper. The second substream is removed from stripper 22 via line 32, warmed in main heat exchanger 20 to provide refrigeration and removed from the process as a gaseous nitrogen product stream via line 34.

An oxygen-enriched bottoms liquid is removed from the bottom of stripper 22 via line 38, reduced in pressure and fed to the sump surrounding reboiler/condenser 28 wherein it is vaporized thereby condensing the nitrogen overhead in line 26. The vaporized oxygen-enriched or waste stream is removed from the overhead of the sump area surrounding reboiler/condenser 28 via line 40.

This vaporized waste stream is then processed to provide refrigeration which is inherent in the stream. In order to balance the refrigeration provided to the process from the refrigeration inherent in the waste stream, stream 40 is split into two portions. The first portion is fed to main heat exchanger 20 via line 44 wherein it is warmed to recover refrigeration. The second portion is combined via line 42 with the warmed first portion in line 44 to form line 46. This recombined stream in line 46 is then split into two parts, again to balance the refrigeration requirements of the process. The first part in line 50 is expanded in expander 52 and then recombined with the second portion in line 48 to form an expanded waste stream in line 54. This expanded waste stream is then fed to and warmed in main heat exchanger 20 to provide refrigeration and is then removed from the process as waste via line 56.

Finally, a small purge stream is removed via line 60 from the sump surrounding reboiler/condenser 28 to prevent the build up of hydrocarbons in the liquid in the sump.

Figure 2:
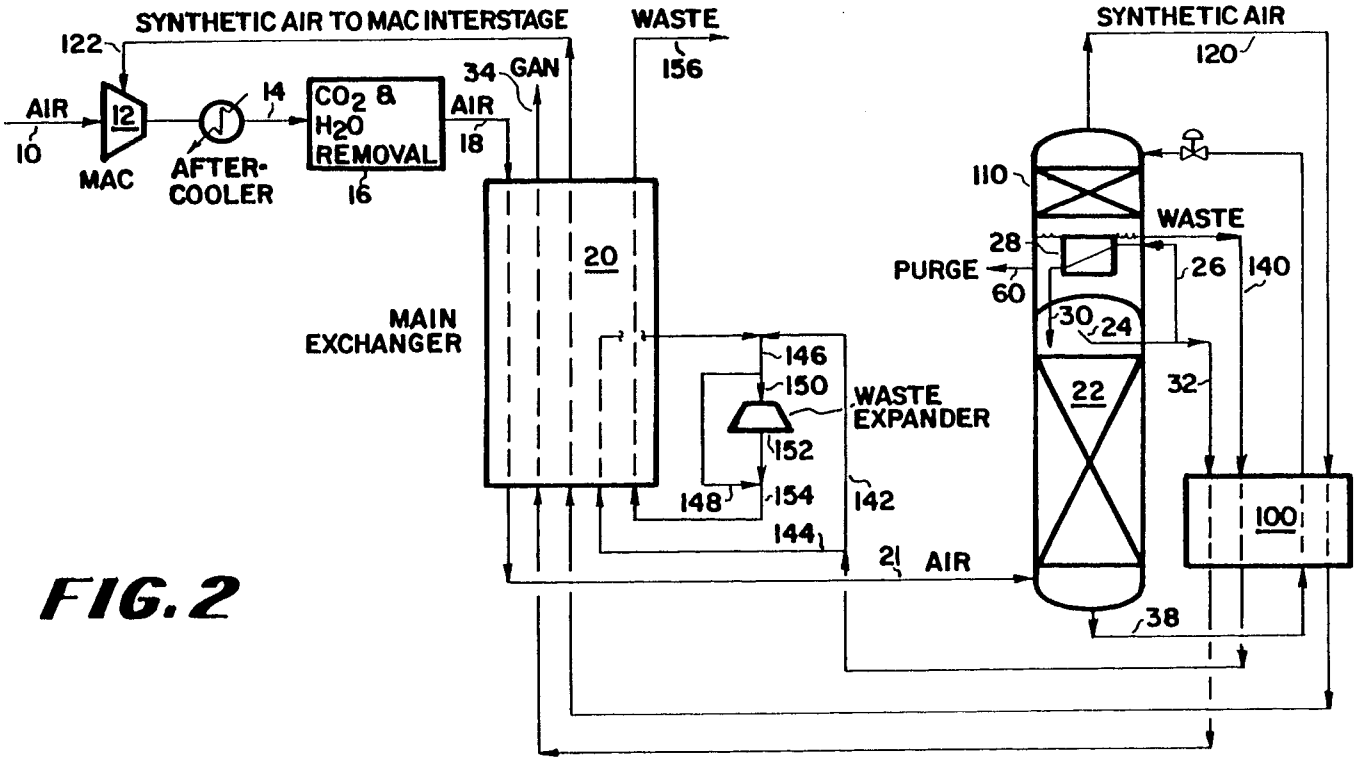
FIG. 2 is a schematic diagram of the process of the present invention.

As stated earlier, the process of the present invention is an improvement to the process shown in FIG. 1. The process of the present invention is shown in FIG. 2; similar process streams in FIGS. 1 and 2 are numbered with the same number. Turning to FIG. 2, the improvement of the present invention is the addition of one or more distillation stages, area 110, to the area above reboiler/condenser 28, which effectively transforms the reboiler/condenser section into a partial low pressure (LP) column and allows further separation (rectification) of the high pressure (HP) column bottom stream in line 38 into two streams: an oxygen-enriched waste stream in line 140 and a synthetic air stream having a composition near that of air in line 120. The distillation stages may be of any type, e.g. trays or structured packing.

The oxygen-enriched waste stream exits the LP column below the bottom tray via line 140 and is expanded to provide refrigeration for the cycle, this expansion process is identical to that described for stream 40 in FIG. 1.

The synthetic air stream is removed from the overhead via line 120 at a composition close to that of air, warmed in main heat exchanger 20 to provide refrigeration and recycled at pressure to main air compressor 12 at an interstage location. This recycle reduces the feed air flow in line 10 to main air compressor 12 thus resulting in a reduction in compressor power.

It is important to note that no product nitrogen is produced from the lower pressure column as occurs in conventional double column processes.

In order to demonstrate the efficacy of the present invention, several computer simulations using a different number of trays in the LP column were made of the process of the present invention. Cycle calculations were based on a GAN production at 115 PSIA with no liquid nitrogen (LIN) production and were made using between one and four distillation trays in the LP column. Table I lists the process specifications and Table II lists the results and a comparison with the standard plant cycle operating at 115 psia. Note that for all the cycles, some expander bypass exists which could be translated into LIN make.

TABLE I

PROCESS SPECIFICATIONS FOR COMPUTER SIMULATIONS

Distillation Section:
HP Column Tray Count: 50
LP Column Tray Count: 1–4
Heat Exchanger Sections:
Main Exchanger NTU Count: 60–70
Overhead Reboiler/Condenser ΔT: 4.35° F.
Compressor/Expander Sections:
Air Feed: 70° F. and 50% Relative Humidity
Isothermal Efficiency: 70%
Motor Efficiency: 95%
Air Compressor Suction Pressure: 14.5 psia
Expander Efficiency: 85%
No power credit for expander

PROCESS CONDITIONS AND FLOW RATES FOR SELECTED STREAMS PROCESS OF FIG. 2

| Stream Number | Phase | Temperature °F. | Pressure psia | Flow Rates: #mol/hr Total | Nitrogen | Argon | Oxygen |
|---|---|---|---|---|---|---|---|
| 10 | VAP | 40.0 | 124.2 | 68.0 | 53.1 | 0.6 | 14.3 |
| 18 | VAP | 45.0 | 120.7 | 99.5 | 78.7 | 1.0 | 19.8 |
| 20 | V&L | −270.9 | 119.6 | 99.5 | 78.7 | 1.0 | 19.8 |
| 32 | VAP | −279.0 | 116.6 | 42.4 | 42.4 | 0.0 | 0.0 |
| 34 | VAP | 40.0 | 115.0 | 42.4 | 42.4 | 0.0 | 0.0 |
| 38 | LIQ | −271.1 | 119.3 | 57.1 | 36.3 | 1.0 | 19.8 |
| 60 | LIQ | −283.4 | 45.3 | 0.1 | 0.0 | 0.0 | 0.1 |
| 120 | LIQ | −294.0 | 45.2 | 31.5 | 25.6 | 0.4 | 5.5 |
| 122 | VAP | 40.0 | 43.8 | 31.5 | 25.6 | 0.4 | 5.5 |
| 140 | VAP | −283.4 | 45.3 | 25.5 | 10.7 | 0.6 | 14.2 |
| 142 | VAP | −277.9 | 44.9 | 11.5 | 4.8 | 0.3 | 6.4 |
| 144 | VAP | −277.9 | 44.9 | 14.0 | 5.9 | 0.3 | 7.8 |
| 146 | VAP | −240.0 | 44.3 | 25.5 | 10.7 | 0.6 | 14.2 |
| 154 | VAP | −277.9 | 16.0 | 25.5 | 10.7 | 0.6 | 14.2 |
| 156 | VAP | 40.0 | 15.0 | 25.5 | 10.7 | 0.6 | 14.2 |

TABLE II

COMPARISON OF THE PROCESS OF THE PRESENT INVENTION WITH A CONVENTIONAL NITROGEN GENERATOR

Basis: Flow from the MAC is fixed at 100 lbmol/hr. The feed air flow to the MAC is varied such that the MAC discharge flow equals 100 lbmol/hr after the addition of the synthetic air recycle flow.

| Case No. | LP Col Tray COUNT | GAN Pressure (psia) | GAN* Recovery % | WASTE Pressure at Expan. (psia) | WASTE Total Flow (#mol/hr) | WASTE $N_2$ (% $N_2$) | SYNTHETIC AIR Pressure at MAC (psia) | SYNTHETIC AIR Total FLOW (#mol/hr) | SYNTHETIC AIR $N_2$ (% $N_2$) | Expander Bypass (#mol/hr) | GAN Spec. Power (kwh/100SCF) |
|---|---|---|---|---|---|---|---|---|---|---|---|
| Double Column Cycle | | | | | | | | | | | |
| 1A | 1 | 115 | 54.8 | 49.2 | 34.3 | 47.2 | 48.7 | 23.9 | 75.2 | 16 | 0.580 |
| 1B | 2 | 115 | 60.6 | 45.6 | 27.5 | 44.7 | 45.1 | 29.6 | 78.9 | 8.4 | 0.561 |
| 1C | 3 | 115 | 62.7 | 44.3 | 25.5 | 42.1 | 43.8 | 31.5 | 81.2 | 6.3 | 0.555 |
| 1D | 4 | 115 | 62.7 | 44.3 | 25.5 | 42.1 | 43.8 | 31.3 | 82.1 | 6.3 | 0.555 |
| Conventional Nitrogen Generator | | | | | | | | | | | |
| 2 | 0 | 115 | 41.6 | 56.5 | 58.2 | 62.7 | — | — | — | 40 | 0.673 |

*GAN Recovery (%) = 100 × GAN/(AIR to MAC)

The power calculations in Table II for the main air compressor (MAC) assumed the synthetic air stream to feed between the second and third stages of a four-stage machine. Depending on the number of trays in the LP column, the pressure of the synthetic air stream varied between 48 and 43 PSIA because of varying reboiler compositions. The MAC interstage pressures were approximated using an equal pressure ratio across each stage (1.71/stage) with a first stage feed pressure at 14.5 PSIA and fourth stage discharge pressure at 125 PSIA. Therefore, the second stage discharge pressure of 42.5 PSIA provided a good match for the synthetic air stream.

As Table 2 shows, the product specific power decreased with increasing LP column tray count. Adding more than three trays showed no reduction in power. The minimum specific power obtained was 0.555 KWH/100 SCF, while the standard plant operating at 115 PSIA and without product compression was 0.673 KWH/100 SCF. This constitutes a 17.5% reduction of specific power.

Process conditions and flow rates for selected streams for the process of the present invention utilizing three trays in the LP column are provided in Table III.

TABLE III

PROCESS CONDITIONS AND FLOW RATES FOR SELECTED STREAMS OF THE PROCESS OF FIG. 2 USING THREE DISTILLATION STAGES IN THE LP COLUMN

| Stream Number | Phase | Temperature °F. | Pressure psia | Flow Rates: #mol/hr Total | Nitrogen | Argon | Oxygen |
|---|---|---|---|---|---|---|---|
| 10 | VAP | 70.0 | 14.5 | 68.0 | 53.1 | 0.6 | 14.3 |
| 18 | VAP | 45.0 | 120.7 | 99.5 | 78.7 | 1.0 | 19.8 |
| 21 | V&L | −270.9 | 119.6 | 99.5 | 78.7 | 1.0 | 19.8 |
| 32 | VAP | −279.0 | 116.6 | 42.4 | 42.4 | 0.0 | 0.0 |
| 34 | VAP | 40.0 | 115.0 | 42.4 | 42.4 | 0.0 | 0.0 |
| 38 | LIQ | −271.1 | 119.3 | 57.1 | 36.3 | 1.0 | 19.8 |
| 60 | LIQ | −283.4 | 45.3 | 0.1 | 0.0 | 0.0 | 0.1 |
| 120 | VAP | −294.0 | 45.2 | 31.5 | 25.6 | 0.4 | 5.5 |
| 122 | VAP | 40.0 | 43.8 | 31.5 | 25.6 | 0.4 | 5.5 |
| 140 | VAP | −283.4 | 45.3 | 25.5 | 10.7 | 0.6 | 14.2 |
| 142 | VAP | −277.9 | 44.9 | 11.5 | 4.8 | 0.3 | 6.4 |
| 144 | VAP | −277.9 | 44.9 | 14.0 | 5.9 | 0.3 | 7.8 |
| 146 | VAP | −240.0 | 44.3 | 25.5 | 10.7 | 0.6 | 14.2 |
| 154 | VAP | −277.9 | 16.0 | 25.5 | 10.7 | 0.6 | 14.2 |
| 156 | VAP | 40.0 | 15.0 | 25.5 | 10.7 | 0.6 | 14.2 |

As can be seen from the above computer simulations, the advantage of the synthetic air recycle concept (the present invention) over the standard plant is that a lower specific power can be achieved while producing GAN directly at 115 psia without product compression. The standard nitrogen plant operating at this pressure has a large excess expander bypass flow. The amount of expander bypass flow is a measure of excess refrigeration in the process and any bypass flow represents a loss of efficiency. The expander bypass is simply let down in pressure with no recovery in pressure energy. Therefore, the process can be made to operate more efficiently by reducing bypass flow while still maintaining the process refrigeration requirements. The present invention lowers the flow to the expander circuit - with a subsequent reduction in expander bypass flow - while maintaining high pressure by further separating the HP column bottom stream into waste and synthetic air streams. The pressure energy contained in the synthetic air stream is recovered by sending it to the MAC interstage location, while the pressure energy of the waste stream is used for process refrigeration.

The possibility for plant retrofit exists with the present invention. The requirements are the addition of two or three trays above the reboiler, splitting the main heat exchanger waste header to provide a circuit for synthetic air recycle and modification to the air compressor first and second stages.

The present invention has been described with reference to several specific embodiments thereof. These embodiments should not be viewed as limitations on the present invention, such limitations being ascertained by the following claims.

We claim:

1. In a process for the separation of air by cryogenic distillation wherein a feed air stream is compressed by a multi-staged main air compressor, cooled to near the dew point of the feed air stream and separated into a nitrogen overhead stream and an oxygen-enriched bottoms liquid in a stripper; at least a portion of the nitrogen overhead is condensed in a reboiler/condenser to provide reflux for the stripper; and at least another portion of the nitrogen overhead is removed from the process as gaseous nitrogen product; the improvement for producing gaseous nitrogen product in a more energy efficient manner comprises:

(a) rectifying the oxygen-enriched bottoms liquid in a distillation zone comprising one or more distillation stages into a synthetic air recycle stream and an oxygen-enriched waste stream;

(b) warming the synthetic air recycle stream to recover refrigeration and subsequently recycling the warmed synthetic air recycle stream to an intermediate stage of the multi-staged main air compressor;

(c) reboiling at least a portion of the oxygen-enriched waste stream in the reboiler/condenser thereby condensing at least a portion of the nitrogen overhead from the stripper and producing a gaseous oxygen-enriched stream; and (d) expanding and subsequently warming at least a portion of the gaseous oxygen-enriched stream to provide refrigeration for the process.

2. The process of claim 1, wherein the distillation zone comprises three or more distillation trays.

3. In a process for the separation of a feed gas stream comprising oxygen and nitrogen by cryogenic distillation wherein the feed gas stream is compressed by a multi-staged main compressor, cooled to near the dew point of the feed gas stream and separated into a nitrogen overhead stream and an oxygen-enriched bottoms liquid in a stripper; at least a portion of the nitrogen overhead is condensed in a reboiler/condenser to provide reflux for the stripper; and at least another portion of the nitrogen overhead is removed from the process as gaseous nitrogen product; the improvement for producing gaseous nitrogen product in a more energy efficient manner comprises:

(a) rectifying the oxygen-enriched bottoms liquid in a distillation zone comprising one or more distillation stages into a synthetic feed gas recycle stream and an oxygen-enriched waste stream;

(b) warming the synthetic feed gas recycle stream to recover refrigeration and subsequently recycling the warmed synthetic feed gas recycle stream to an intermediate stage of the multi-staged main compressor;

(c) reboiling at least a portion of the oxygen-enriched waste stream in the reboiler/condenser thereby condensing at least a portion of the nitrogen overhead from the stripper and producing a gaseous oxygen-enriched stream; and (d) expanding and subsequently warming at least a portion of the gaseous oxygen-enriched stream to provide refrigeration for the process.

* * * * *